US005813516A

United States Patent [19]

Honegger

[11] Patent Number: 5,813,516

[45] Date of Patent: Sep. 29, 1998

[54] APPARATUS FOR CONVEYING ARTICLES, IN PARTICULAR SHEET-LIKE, FLEXIBLE PRODUCTS

[75] Inventor: Werner Honegger, Bäch, Switzerland

[73] Assignee: Ferag AG, Hinwil, Switzerland

[21] Appl. No.: 543,354

[22] Filed: Oct. 16, 1995

[30] Foreign Application Priority Data

Mar. 16, 1995 [CH] Switzerland ..... 00751/95

[51] Int. Cl.[6] ..... B65G 15/16

[52] U.S. Cl. ..... 198/604; 198/778; 198/811

[58] Field of Search ..... 198/347.1, 347.31, 198/347.4, 778, 604, 607, 811, 543, 325

[56] References Cited

U.S. PATENT DOCUMENTS

| | | | |
|---|---|---|---|
| 1,861,335 | 5/1932 | Cainet al. | 198/778 X |
| 2,873,020 | 2/1959 | Kay | 198/347.1 |
| 4,589,606 | 5/1986 | Staub . | |
| 4,757,952 | 7/1988 | Balzer . | |
| 5,154,036 | 10/1992 | Focke et al. . | |

FOREIGN PATENT DOCUMENTS

| | | |
|---|---|---|
| A-0141394 | 5/1985 | European Pat. Off. . |
| A-0441136 | 8/1991 | European Pat. Off. . |
| WO-A-8501278 | 3/1985 | WIPO . |

*Primary Examiner*—Donald W. Underwood
*Attorney, Agent, or Firm*—Brinks, Hofer, Gilson & Lione

[57] ABSTRACT

The conveying apparatus is formed by two conveying sections which are arranged one behind the other, and are in the form of spirals that wind around a center such that the windings of the two conveying sections are nested one inside the other. Each spiral conveying section has a stationary guide surface which supports the articles to be conveyed on a surface that faces outwardly away from the center. Each spiral conveying section also includes a conveying system, that has at least one endless, flexible conveying element which is driven such that it circulates around the conveying section. The conveying element acts on the outer side of the articles to be conveyed. There is also an endless flexible support member between the articles to be conveyed and the guide surface, that circulates around the spiral conveying section, and is in the form of a band that overlays the guide surface. The support member is carried along by the articles being conveyed.

35 Claims, 6 Drawing Sheets

APPARATUS FOR CONVEYING ARTICLES, IN PARTICULAR SHEET-LIKE, FLEXIBLE PRODUCTS

BACKGROUND OF THE INVENTION

The present invention relates to an apparatus for conveying articles, in particular sheet-like, flexible products.

An apparatus for conveying sheet-like, flexible printed products, including two conveying sections that spiral around a center and are arranged one behind the other, is disclosed in Swiss Patent Application No. 00009/95-5 filed on Jan. 3, 1995. In Swiss Patent Application No. 00009/95-5 one conveying section extends from an inlet, which is offset towards the outside with respect to the center, to the center. This apparatus is intended for the temporary storage of folded products and can accommodate a large number of products in a small space. The one conveying section is joined at the center, by the second conveying section, the outlet of which is on the outside. The windings of one conveying section extend between the windings of the other conveying section. Each conveying section has a stationary guide surface which supports the articles to be conveyed inwardly, that is towards the center. To convey the articles, a conveying device is used which comprises either one conveying system which is common to both conveying sections or two conveying systems each assigned to one of the two conveying sections. The conveying system, or each of the conveying systems, has at least one endless conveying element which is driven in circulation and acts on the products which are to be conveyed. The endless conveying element engages the side of the product that is remote from the guide surface.

The guide surfaces of the two conveying sections are formed as roller surfaces on which the articles to be conveyed directly rest during the course through the conveying sections. Particular in the case of flexible, sheet-like products, for example newspapers, periodicals and parts thereof, this has the disadvantage that, during the movement over the rollers, the articles to be conveyed are exposed to a flexing action which can damage the products. In addition, as a result of the frictional resistance, between the articles to be conveyed and the roller surfaces, which increases in the outer windings of the conveying sections, correspondingly high drive power is necessary for the conveying device. This high frictional resistance is caused by an effect that corresponds to the frictional resistance that exist when something is sliding along a rope.

SUMMARY OF THE INVENTION

The object of the present invention, is to provide a conveying apparatus of the type disclosed in a U.S. application that is being filed concurrently with this application and which is based upon the above-identified Swiss Patent Application No. 00009/95-5, in which the articles to be conveyed, by the spiral conveying section or sections, are conveyed along an endless flexible support member and the power requirements for the drive are minimal.

This invention consist of an apparatus for conveying articles, in particular sheet-like, flexible articles, having at least one conveying section that spirals around a center and in which the inlet is at the center of the spiral.

This invention consists of an apparatus for conveying articles, in particular sheet-like, flexible articles, having at least one conveying section that spirals around a center and in which the inlet is offset towards the outside of the center of the spiral.

This invention consists of an apparatus for conveying articles, in particular sheet-like, flexible articles, having a stationary guide surface which supports the articles outwardly away from the center of the conveying section.

This invention also consists of an apparatus for conveying articles, in particular sheet-like, flexible articles, having a conveying system assigned to a conveying section, and an endless, flexible conveying element which is circulated and of which the conveying surface extends along the guide surface and engages the articles being conveyed, on their side that is remote from the guide surface.

This invention further consists of an apparatus for conveying articles, in particular sheet-like, flexible articles, including an endless, flexible belt or support member which supports the material being conveyed along the feed surface, and is guided along the guide surface such that it supports the material.

In accordance with this invention the articles to be conveyed are carefully handled when moving through the conveying section while reducing the friction resistance, with the result that a considerably lower drive power is required for the conveying system. This has been achieved as a result of the flexible, endless belt member which is arranged between the stationary guide surface and the articles to be conveyed. The flexible, endless belt member is conveyed along with the articles to be conveyed.

BRIEF DESCRIPTION OF THE DRAWINGS

The embodiments of the invention are explained in more detail with reference to the drawings, in which.

DETAILED DESCRIPTION OF THE PREFERRED EMBODIMENTS

Figure 1:
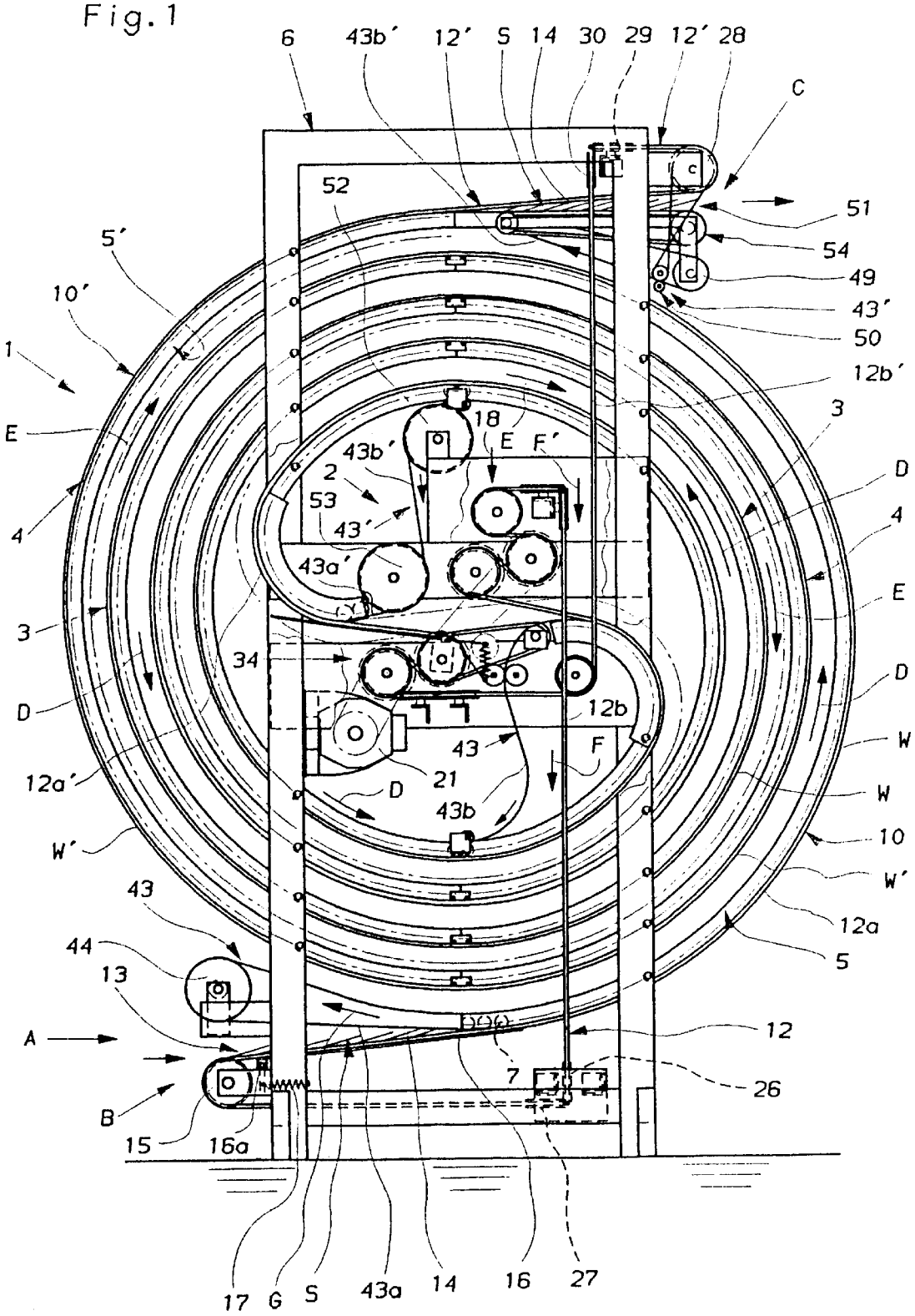
FIG. 1 shows a side view of a conveying apparatus according to the invention, having two conveying sections in the form of a spirals.

FIG. 1 is a side view of a conveying apparatus 1, which is formed by two spiral conveying sections 3, 4 that spiral around a center 2. The first conveying section 3 extends from an inlet B, which is located on the outside of the spiral relative to the center 2, towards the center 2. The conveying direction of the first conveying section 3 is designated by arrow D. The second conveying section 4 adjoins the first conveying section 3 at the center 2 and extends from the center 2 outward to an outlet C, which is located on the outside of the spiral with respect to the center 2. The conveying direction E of the second conveying section 4 is counter to the conveying direction D of the first conveying section 3. However, the articles to be conveyed make a smooth transition from section 3 to section 4 and thus continue to be conveyed in the same conveying direction. Thus, there is no reversal in the conveying direction of the articles 13. The two conveying sections 3, 4 are nested one inside the other. Thus, the windings W of conveying section 3 extend between the windings W' of the other conveying section 4 and vice versa.

Figure 4:
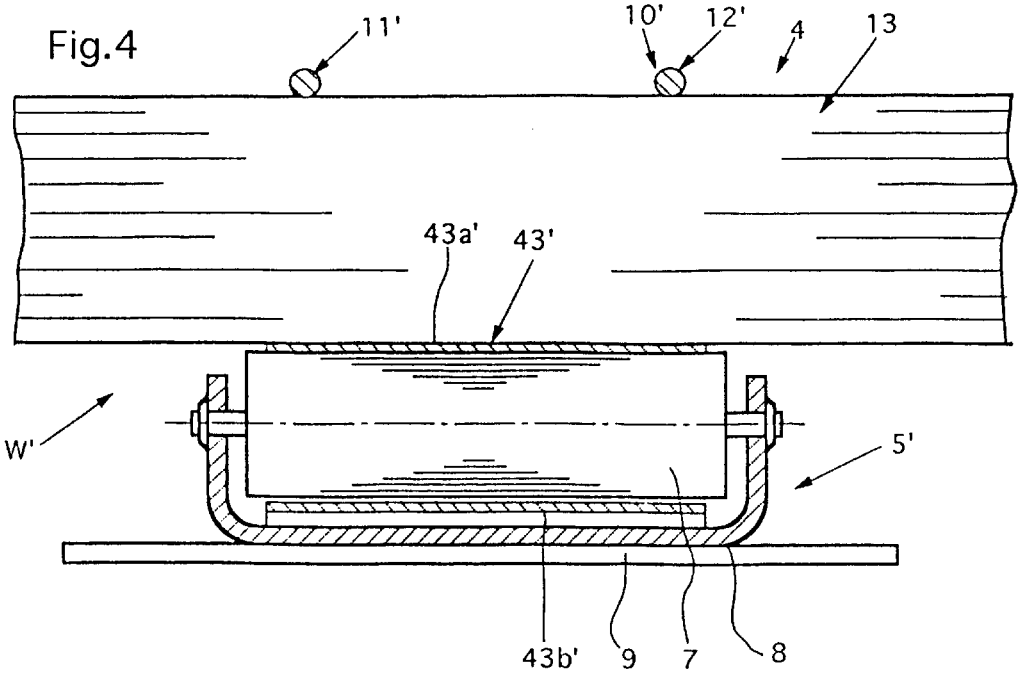
FIG. 4 is a cross-section view taken along the line IV—IV of FIG. 3.
Figure 3:
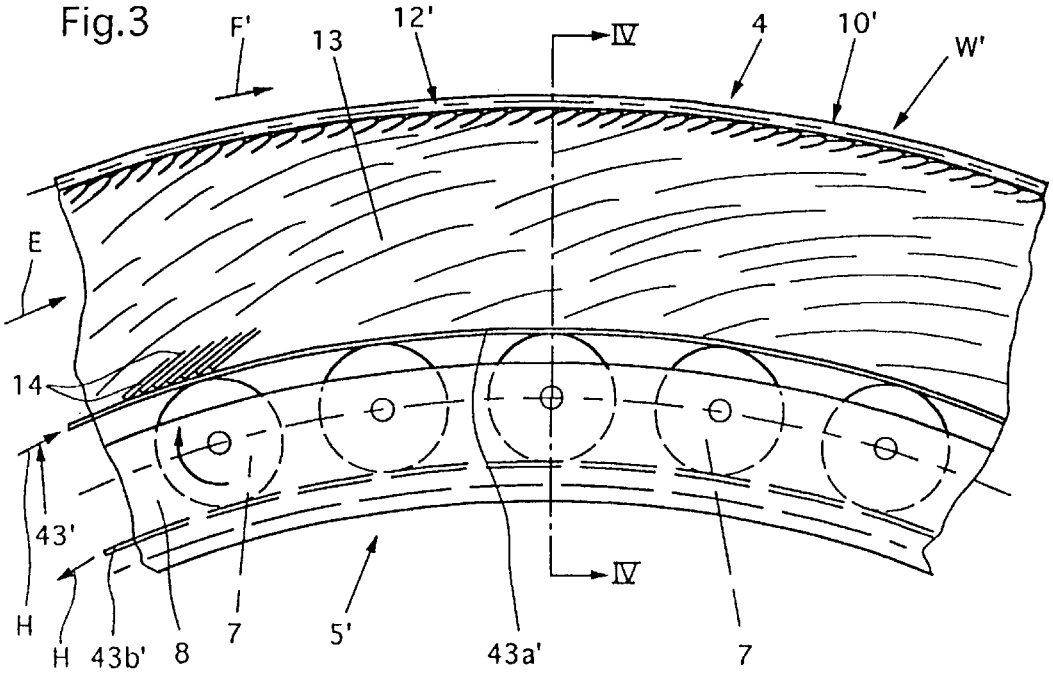
FIG. 3 is an enlarged scale, of a region of the conveying section, that extends towards the outside from the center, of the conveying apparatus that is shown in FIG. 1.

The construction of the conveying sections 3 and 4 can be best seen in FIGS. 3 and 4, which are a side view and a cross-section view, respectively, of an enlarged region of the innermost winding W' of the second conveying section 4. FIGS. 3 and 4 illustrate the section of the conveying section 4 that is located above center 2.

Each conveying section 3, 4 has a stationary, spiral guide surface 5, and 5' respectively. The guide surfaces 5, 5' are anchored to a frame 6, and in this embodiment, are formed by the surfaces of a series of rollers 7. The rollers 7, that form the guide surfaces are mounted for free rotation in a mount 8 that has a U-shaped cross-section. The mount 8 is fastened to a stationary support 9. Each conveying section 3, 4 has a conveying system 10 and 10' respectively. Conveying systems 10 and 10' each have two endless, flexible conveying elements 11 and 12 and 11' and 12', respectively, which are driven along a circulation path. In the embodiment shown, the two conveying elements 11 and 12 and 11' and 12' are continuous belts, which are particularly well suited for deflecting in the required direction. The articles 13 to be conveyed, are in the preferred embodiment printed products 14, for example newspapers, periodicals and parts thereof. The articles 13, pass, at the inlet B of the conveying section 3, between the guide surface 5 and the conveying elements 11, 12. The printed products 14 are fed in an imbricated formation S and leave the conveying apparatus 1, at the outlet C, in the same imbricated formation S. The guide surfaces 5, 5' support the articles 13 outwardly, that is away from the center 2, while the conveying elements 11, 12 and 11', 12' act on the articles 13, on the outer side of the latter. The conveying elements 11, 12 are driven in circulation in the direction of the arrow F, see FIG. 1, in a manner which will be described in more detail in a later portion of this specification. The direction of circulation of the conveying elements 11', 12' is designated by arrow F'. The direction of circulation F of the conveying elements 11, 12 corresponds to the conveying direction D and the direction of circulation F' of the conveying elements 11', 12' corresponds to the conveying direction E.

Figure 2:
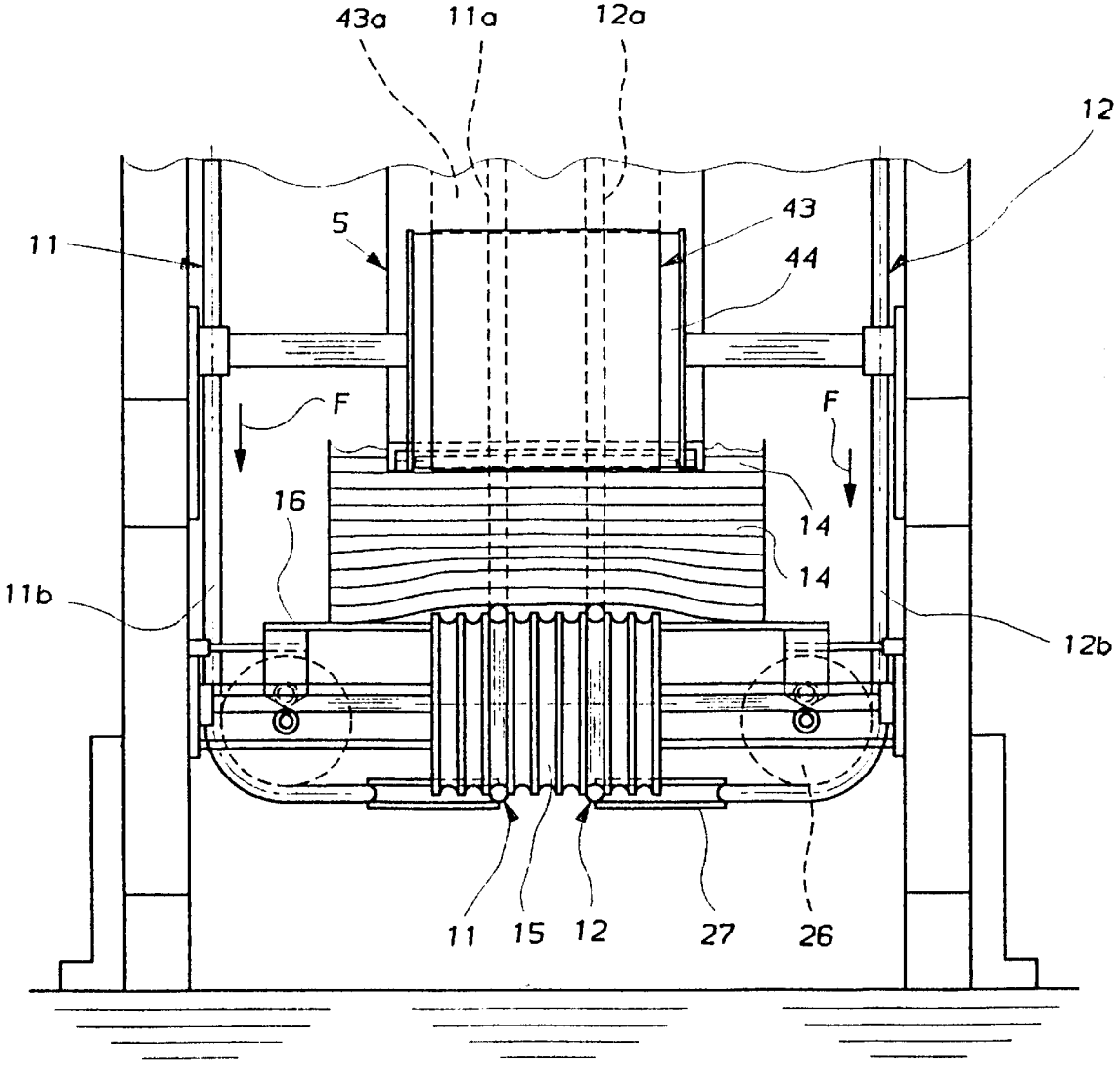
FIG. 2 shows a front view of the lower part of the conveying apparatus extending in the direction of the arrow A seen in FIG. 1.
Figure 5:
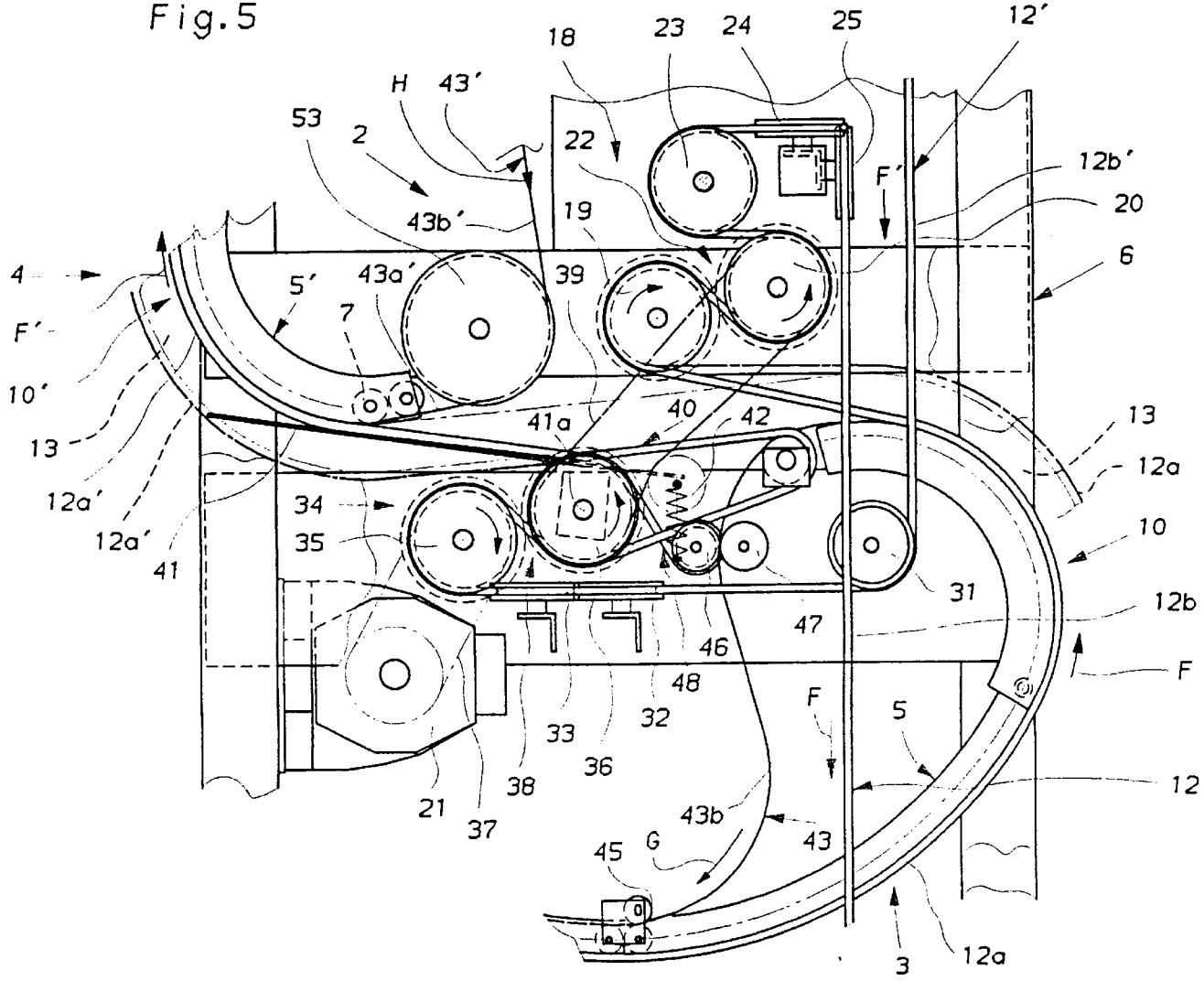
FIG. 5 is an enlarged scale, of a region in the center of the conveying apparatus that is seen in FIG. 1.

With reference to FIGS. 1, 2 and 5, which show the region of the center 2 on an enlarged scale, the progression of the conveying elements 11, 12 and 11', 12' of the conveying systems 10, 10', respectively, will now be discussed. It should be noted that, only the conveying elements 12 and 12' can be seen in FIGS. 1 and 5. The other conveying elements 11 and 11' are located behind elements 12 and 12' and as seen in FIG. 2 extends in a manner corresponding to the conveying elements 12 and 12'.

The conveying strands 11*a*, 12*a* of the conveying elements 11, 12 extend from a deflection roller 15, that is rotatably mounted on the frame 6 at the inlet B of the first conveying section 3. The conveying strands 11*a*, 12*a* extend over a metal supporting plate 16 that is pivotally mounted on the frame 6 such that it can be pivoted about an axis 16*a* (see FIG. 1). A tension spring 17 acts on the metal supporting plate 16, to press it against the guide surface 5. The conveying strands 11*a*, 12*a* are located beneath the imbricated formation S and run over the metal supporting plate 16. The conveying strands 11*a*, 12*a* then extend along the guide surface 5 on the outer side of the articles 13. The conveying elements 11, 12 extend over a deflection-roller arrangement 18, at the center 2. The deflection-roller arrangement 18 includes two deflection rollers 19, 20 which are driven in opposite directions. Deflection roller 20 is driven in the counter-clockwise direction, in a manner to be described, by a drive motor 21 that is mounted on the frame 6 (FIG. 5). The deflection roller 19 is driven by the deflection roller 20, through a toothed gearing mechanism 22. The deflection arrangement 18 further comprises a third deflection roller 23, which is mounted in a freely rotatable manner. The return strands of the conveying elements 11, 12 run behind the deflection-roller arrangement 18 over two freely rotatably mounted deflection rollers 24, 25. The axes of rotation of deflection rollers 24, 25 are at right angles with respect to one another, and the conveying elements 11, 12 are then guided downwards to the side of the guide surfaces 5, 5'.

As can be seen in FIGS. 1 and 2, the return strand 12*b* of the conveying element 12, in the region of the lower end of the frame 6, is guided back to the deflection roller 15 over two freely rotatably mounted deflection rollers 26, 27.

The corresponding paths that conveying elements 11', 12' follow and their guidance devices will be discussed hereinafter as a part of the discussion specifically directed to the conveying element 12' with reference to FIGS. 1 and 5.

The conveying strand 12*a*', which also runs on the outer side of the articles 13, is guided from the center 2 along the guide surface 5' to the outlet C of the second conveying section 4 and it extends around a rotatably mounted deflection roller 28 (see FIG. 1). The return strand 12*b*' then runs over two deflection rollers 29, 30 which are mounted for free rotation on the frame. The axes of rotation of deflection rollers 29, 30 are at right angles with respect to one another, and correspond in functional terms to the deflection rollers 24, 25. After exiting these deflection rollers 29, 30, the return strand 12*b*' is guided downwards to the center 2 along the side of the guide surfaces 5, 5'. The return strand 12*b*' is then guided around a first, freely rotatable deflection roller 31 and then around a pair of freely rotatable deflection rollers 32, 33 (see FIG. 5). From the deflection rollers 32, 33, the conveying element 12' runs over a deflection-roller arrangement 34. Deflection-roller arrangement 34 functions as a drive, in the same way as deflection-roller arrangement 18 for the conveying element 12. The deflection-roller arrangement 34 is formed by two deflection rollers 35 and 36, of which deflection roller 35 is driven in the clockwise direction by the drive motor 21 through a chain 37. The deflection roller 36 is driven by deflection roller 35 through a toothed gearing mechanism 38. A sprocket wheel is connected to and rotates with deflection roller 36, over which a chain 39 extends which is guided by another sprocket wheel which is coaxial with and fixed to rotate with deflection roller 20. Thus, chain 39, drives the deflection roller 20 through the deflection-roller arrangement 34.

The discharge of the first conveying section 3 is joined by a belt conveyor 40, which is guided over a deflection roller that is coaxial with the deflection roller 36. The articles 13 leave the conveying section 3 and are first transferred to the belt conveyor 40 and then to the conveying elements 11' and 12'. The conveying elements 11' and 12', after leaving the deflection roller 36, extend over a metal supporting plate 41, which is mounted on the frame 6 such that it can be pivoted about axis 41*a*. The metal supporting plate 41 is pressed against the guide surface 5' by a tension spring 42.

In the region of the guide surfaces 5, 5', the articles 13 are located on the flexible and circulating belt member 43 and 43', respectively, which are in the form of bands or belts that are guided in an endless loop. The feed strands 43*a* and 43*a*' extend over the rollers 7 and thereby span the spaces between the rollers 7, as can be best seen in FIG. 3. The return strands 43*b* and 43*b*' of the belt members 43, 43' are guided back beneath the rollers 7 and lies within the roller mount 8 (see FIGS. 3 and 4). The direction of circulation G and H of the belt members 43 and 43' corresponds to the conveying directions D and E, since the belt members 43 and 43' are frictionally driven by the articles 13. The belt members 43 are formed from a material, which can be subjected to both tensile and compressive loading. A suitable material is, for example, a steel band preferably made of spring steel. It is important that the frictional conditions between the articles 13 and the belt members 43, 43' permit the belt members 43, 43' to be carried along by the articles 13, and also permits belt member 43, 43' to be moved with respect to the articles 13. This is necessary in order to compensate for differences in speed between the articles 13 and the belt members 43, 43'.

The guidance of the belt members 43 and 43' will now be described with reference to FIGS. 1, 2 and 5.

The belt member 43 assigned to the conveying section 3 is guided over a deflection roller 44, located at the inlet B of the conveying section 3 and mounted in a freely rotatable manner. The conveying strand 43*a*, of belt member 43 contacts rollers 7 of the guide surface 5. After leaving the guide surface 5 at the center 2, the belt member 43 is returned and follows an S pattern to make this reversal (see FIGS. 1 and 5). The return strand 43*b* of the belt member 43 passes under a feed roller 45 (FIG. 5) as it returns to the interior of the U-shaped mount 8. Between leaving the guide surface 5 and re-entering it, the return strand 43*b* runs through a pair of rollers 46, 47, of which the roller 46 is driven. Roller 46 is driven by a crossed drive belt 48, with a drive roller (not shown) which is coaxially with and fixed to roller 36 such that it rotates therewith. The drive provided by the pair of rollers 46, 47 assists the return movement of the belt member 43 into the guide surface 5.

The belt member 43', which is assigned to the conveying section 4, is guided in a fashion similar to belt member 43. Belt member 43' extends around a deflection roller 49 that is located at the outlet C of the conveying section 4. The return strand 43*b*', after leaving deflection roller 49, extends between a pair of rollers 50 (FIG. 1). One roller of the pair of rollers 50 is driven, by a crossed drive belt 51, by a drive roller (not shown) which is coaxially with and connected to deflection roller 28 such that it rotates therewith. The pair of rollers 50 thus functions in the same manner as the pair of rollers 46, 47. After exiting the roller mount 8 at the center 2, the return strand 43*b*' of the belt member 43', extends over two deflection rollers 52 and 53. As the return strand 43*b*' is discharged from the deflection roller 53 it re-enters the guide surface 5' such that it contacts the surfaces of and spans the gaps between the rollers 7 (see FIGS. 4 and 5).

The functioning of the conveying apparatus 1 will be reviewed at this point to supplement and clarify the previous description.

The articles 13 to be conveyed, which in the present case, are printed products 14 arranged in an imbricated formation S, are fed to the inlet B of the first conveying section 3 and conveyed along the conveying section 3 to the center 2.

To accomplish this, use is made of the conveying elements 11 and 12 which are driven, in the direction of the arrow F. At the center 2, the articles 13 are fed by a belt conveyor 40 to the inlet of the second conveying section 4 and are conveyed along the conveying section 4 to its outlet C. In conveying section 4 the articles 13 are driven by the conveying elements 11' and 12' which are driven such that they circulate in the direction of the arrow F'. There is a removal means 54 located at the outlet C of the second conveying section 4, which receives the imbricated formation S as it exits the guide surface 5' and functions to guides the imbricated formation away.

The spaces between rollers 7 are covered by the belt member 43, 43' and are arranged between the articles 13 and the roller surface 5, 5', with the result that the articles are guided in a protected manner across the spaces and also over the rollers 7 without being exposed to a flexing action. The power required for driving the conveying elements 11, 12 and 11', 12' is, in this manner, reduced. The belt member 43, 43' also permits a larger space between the rollers 7.

Figure 6:
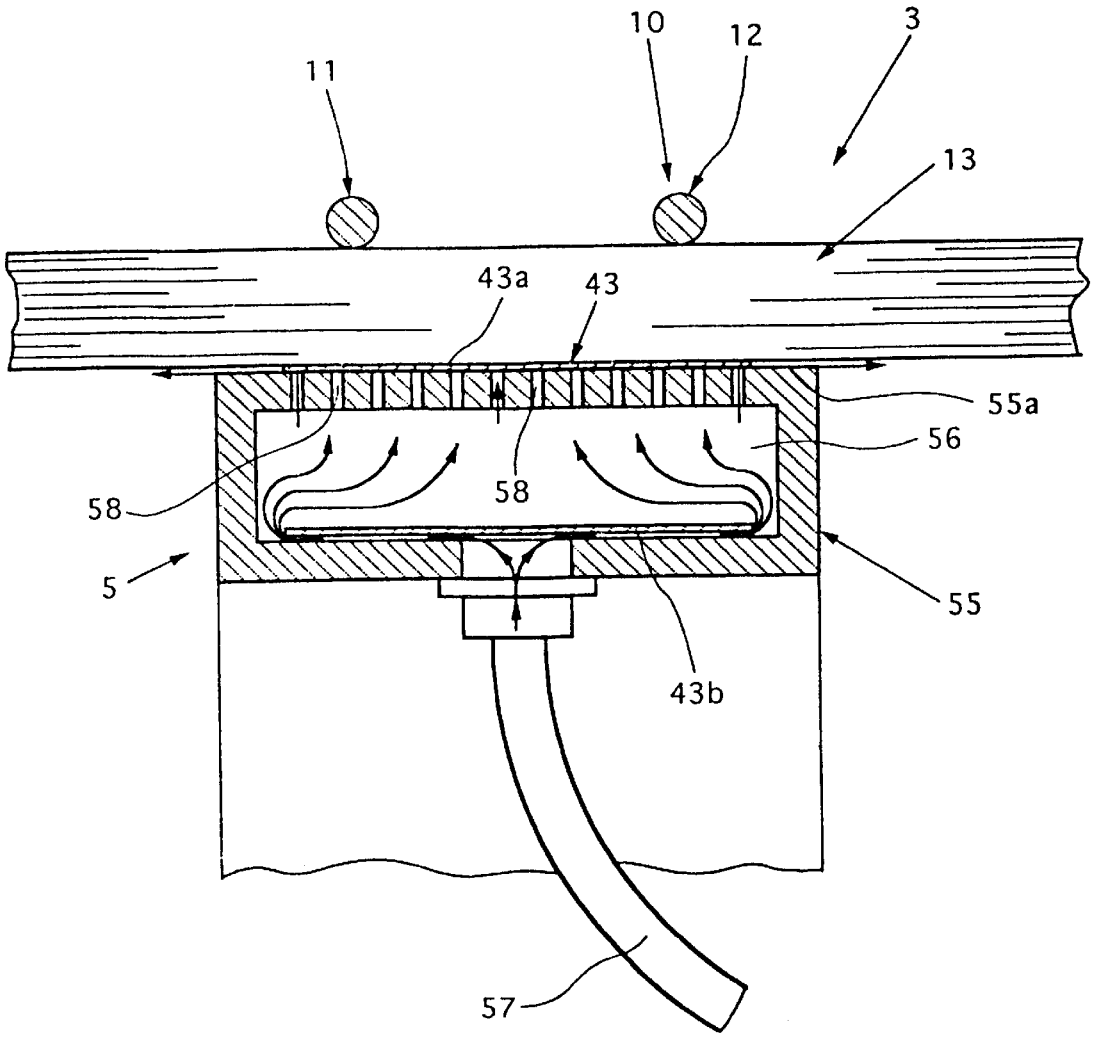
FIG. 6 is a cross-section view similar to FIG. 4, of another embodiment of the guide surface of the conveying sections.

Another embodiment of the guide surfaces 5 and 5' is illustrated in FIG. 6. FIG. 6 is a view that corresponds to FIG. 4. In the embodiment shown in FIG. 6, instead of a roller surface, the guide surfaces 5, 5' are formed by an air duct 55, which is fastened to the frame 6. An interior cavity 56 of the air duct 55 is connected through a connecting line 57, to a compressed-air source (not shown). On the side facing articles 13, the air duct 55 is provided with outlet openings 58 which communicate between the interior cavity 56 and the planar supporting surface 55*a* of the air duct 55. The feed strand 43*a* of the belt member 43 lies flat on supporting surface 55*a*, while the return strand 43*b* of the belt member 43 is guided to return along the base of the interior cavity 56. The return strand 43*b* could, however, also be guided such that it runs outside the air duct 55. The compressed air that is being discharged through the outlet openings 58 forms, beneath the belt member 43, an air cushion which supports the belt member 43 and the articles 13.

Figure 7:
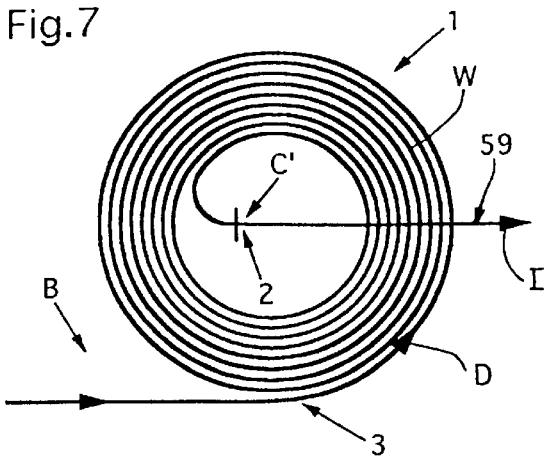
FIG. 7 is a side view of an embodiment of conveying apparatus having only one spiral conveying section.
Figure 8:
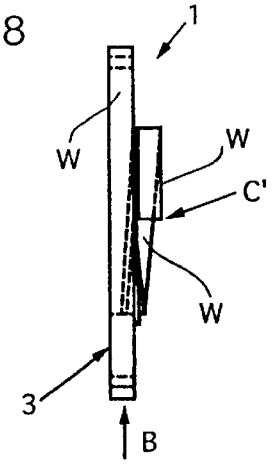
FIG. 8 is an end view of the embodiment of conveying apparatus, shown in FIG. 7, having only one spiral conveying section.
Figure 9:
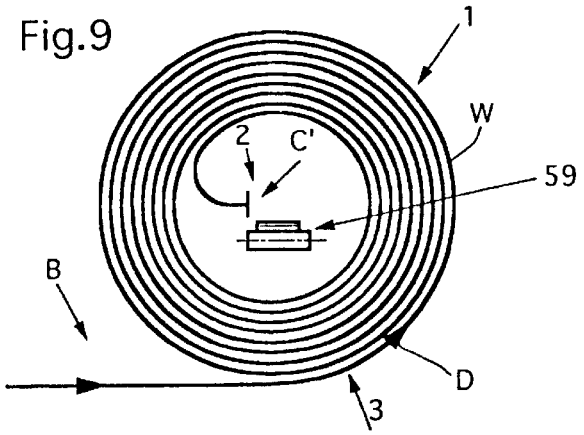
FIG. 9 is a side view of another embodiment of a conveying apparatus having only one spiral conveying section.

The embodiments which are schematically illustrated in FIGS. 7–9 differ from the embodiment shown in FIG. 1 in that the conveying apparatus 1 has only one conveying section 3, which extends in the form of a spiral around the center 2. The inlet of the conveying section 3 is designated B. The outlet for the conveying apparatus 1 is designated C'. In this embodiment, the outlet C' is located at the center 2, while the inlet B is offset towards the outside with respect to the center 2. It is, however, also intended to provide an apparatus 1 of the type shown in FIGS. 7–9 with an inlet B at the center 2, and an outlet C' that is located on the outside.

In the embodiment illustrated in FIGS. 7 and 8, the windings W of the conveying section 3 are offset somewhat laterally with respect to one another, as can be best seen in FIG. 8. This makes it possible for the outlet C' to be freely accessible from the side although it is located in the center 2 of the spiral formed by the conveying section 3. This embodiment makes it possible to guide the articles away as they leave the conveying apparatus 1 at the outlet C' in a direction that is essentially parallel to the feed direction of the articles fed to the inlet B of the conveying section 3. This discharge arrangement is illustrated in FIG. 7 by the schematically represented removal conveyor 59. The removal conveyor 59 has a conveying direction I which is essentially parallel to the feed direction of the articles.

In the embodiment illustrated in FIG. 9, the windings W of the conveying section 3 are not offset laterally with respect to one another. The outlet C' of the conveying apparatus 1 is thus not accessible from the side. Articles leaving the conveying section 3 are thus guided away from the center 2 by means of a removal conveyor 59 which extends transverse to the conveying direction. This removal conveyor 59 extends, approximately at right angles, with respect to the conveying direction D of the conveying section 3. The articles leaving the conveying apparatus 1 at the outlet C' are deposited, at the center 2, onto the removal conveyor 59. The removal conveyor 59 is preferably in the form of a belt conveyor.

Figure 10:
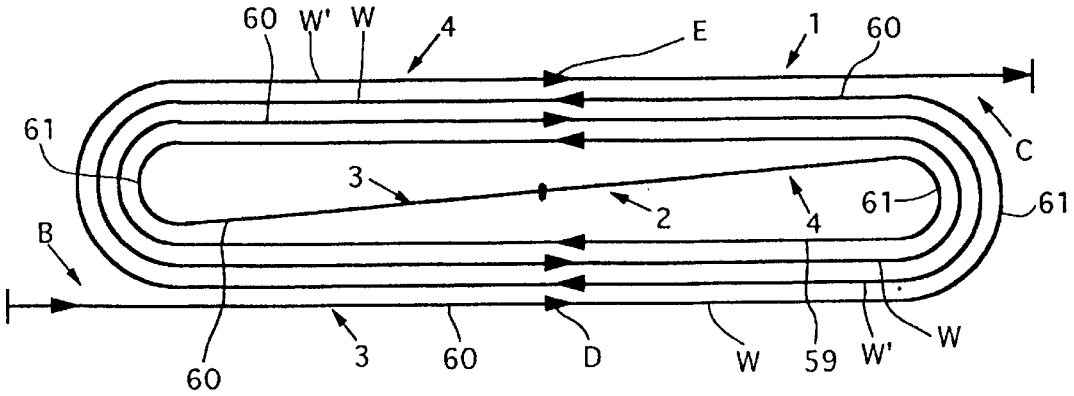
FIG. 10 is a side view of another embodiment of conveying apparatus in which the conveying sections progress in a different manner than in the previous illustrated embodiments.

In the embodiment that is schematically illustrated in FIG. 10, the conveying sections 3 and 4 do not, as in the earlier embodiments, have a constant curvature, rather they include rectilinear portions 60 and curved portions 61. The curved portions 61 connect the rectilinear portions 60 to one another. However, here too, the conveying sections 3 and 4 run in the manner of a spiral around a center 2. The windings W of one conveying section 3 are likewise located between windings W' of the other conveying section 4 and vice versa.

It is also possible, in the embodiment illustrated in FIG. 10, to provide only one conveying section, as illustrated and described with reference to FIGS. 7 and 9.

In contrast to the previous embodiments, in which the conveying sections 3 and 4 are constantly curved, the linear guidance sections of FIG. 10, have the disadvantage that the flexible articles 13 are not constantly curved as they run through the conveying sections 3 and 4. This disadvantage is particularly evident in the case of printed products 14.

In the embodiments illustrated in FIGS. 7–10, the construction of the conveying sections 3 and 4 corresponds to the construction of the conveying sections 3, 4 which have been described with reference to FIGS. 1–6.

It should be noted that instead of using rollers 7, as shown in FIG. 4, in which the width is approximately equal to the width of the belt members 43, 43', narrower rollers which are offset laterally with respect to one another can be used. The rollers would be offset laterally as seen in the conveying direction of the articles 13. This feature would ensure reliable support for the feed strands 43*a*, 43*a*' of the belt members 43, 43' although the roller width is less than the width of the belt members 43, 43'.

A still further embodiment has some sections of the guide surfaces 5, 5' in the form of an air duct according to FIG. 6 and other sections as roller surface, as is shown for example in FIGS. 3 and 4. In this regard, the guide surfaces 5, 5' to be formed as an air duct 55, could for example, be located only in the region located above the center 2. In this upper region, the guide surfaces 5, 5' must bear the weight of the articles 13, whereas in the region located beneath the center 2, the weight of the articles 13 is borne by the conveying elements 11, 12 and 11', 12'.

The conveying systems 10, 10' may also have more than two conveying elements 11, 12 and 11', 12' or also may have only one conveying element, which, however, is of a certain width. For conveying elements 11, 12 and 11', 12', use is made, in the preferred embodiment of round belts which can be deflected in a simple manner in a wide variety of directions.

The conveying apparatus 1 may be arranged at any attitude, for example instead of being vertically arranged, as is shown, it may also be arranged horizontally or in an oblique position.

Instead of being used to convey printed products 14, as has been shown, the conveying apparatus 1 shown may also be used to convey other articles, which do not necessarily have to be sheet-like or flexible, for example bottles or similar articles, which are held between the conveying elements 11, 12 and 11', 12' and the guide path 5, 5' such that they extend transversely with respect to the conveying direction D, E.

It is intended that the accompanying drawings and foregoing detailed description are to be considered in all respects as illustrative and not restrictive; the scope of the invention is intended to embrace any equivalents, alternatives, and/or modifications of elements that fall within the spirit and scope of the invention, and all changes which come within the meaning and range of equivalency of the claims are therefore intended to be embraced therein.

What is claimed is:

1. An apparatus for conveying articles, comprising:

a spiral conveying section disposed around a center;

an inlet for said apparatus offset radially with respect to said center;

said spiral conveying section including a stationary guide path having a supporting surface that faces outwardly away from said center for supporting the articles on their inwardly facing side;

said spiral conveying section having a conveying system for conveying the articles along said stationary guide path;

said conveying system including a driven endless flexible conveying element that circulates around said spiral conveying section and is adapted to engage the articles to be conveyed on their outwardly facing side;

said conveying system including an endless flexible support member that overlays said guide path and is guided such that it circulates around said spiral conveying section and is adapted to support the articles on its inwardly facing side.

2. An apparatus according to claim 1, wherein said spiral conveying section is constantly curved.

3. An apparatus according to claim 1, wherein said spiral conveying section comprises essentially rectilinear portions and curved portions, said curved portions connect said rectilinear portions to one another.

4. An apparatus according to claim 1, including a second spiral conveying section that is formed about said center, and corresponds to the first spiral conveying section;

a conveyor joining said second spiral conveying section and the first spiral conveying section at the center, along which the articles are transferred from one spiral conveying section to the other;

the inlet of one spiral conveying section and the outlet of the other spiral conveying section being offset towards the outside with respect to the center.

5. An apparatus according to claim 4, wherein said second spiral conveying section includes a second conveying system which corresponds to the first conveying system, said second conveying system functions to convey articles along said second spiral conveying section.

6. An apparatus according to claim 4, wherein the first spiral conveying section includes first windings and said second spiral conveying section includes second windings, said first windings run between said second windings and said second windings run between said first windings.

7. An apparatus according to claim 1, wherein said driven endless flexible conveying element and said endless flexible support member include return strands that are guided back along the guide paths.

8. An apparatus according to claim 1, wherein said support member comprises a steel band that is subjected to tensile and compressive forces.

9. An apparatus according to claim 1, wherein said endless flexible support member includes a return strand, and an advancement device that acts on the return strand of the support member and functions to advance the support member in the direction of circulation thereof.

10. An apparatus according to claim 1, wherein at least a portion of said guide path is formed by a series of rollers.

11. An apparatus according to claim 1, wherein at least a portion of said guide path is formed as an air duct which is connected to a compressed-air source and is provided with air-outlet openings which open towards the support member which is guided along the air duct.

12. An apparatus according to claim 1, in which the conveying elements comprise round belts.

13. An apparatus according to claim 1, including a deflection roller and a drive motor and wherein said conveying elements are guided over the deflection roller which is driven by said drive motor.

14. An apparatus according to claim 1 wherein the articles to be conveyed comprise newspapers, periodicals and parts thereof and supplements therefor, which are arranged in an imbricated formation.

15. An apparatus according to claim 4, wherein said driven endless flexible conveying element and said endless flexible support member include return strands that are guided back along the guide paths.

16. An apparatus according to claim 4, wherein said support member comprise a steel band that is subjected to tensile and compressive forces.

17. An apparatus according to claim 4, wherein said endless flexible support member includes a return strand, and an advancement device that acts on the return strand of the support member and functions to advance the support member in the direction of circulation thereof.

18. An apparatus according to claim 4, wherein at least a portion of said guide path is formed by a series of rollers.

19. An apparatus according to claim 4, wherein at least a portion of said guide path is formed as an air duct which is connected to a compressed-air source and is provided with air-outlet openings which open towards the support member which is guided along the air duct.

20. An apparatus according to claim 4, wherein the conveying elements comprise round belts.

21. An apparatus according to claim 4, including a deflection roller and a drive motor and wherein said conveying elements are guided over the deflection roller which is driven by the drive motor.

22. An apparatus for conveying articles, comprising:

a spiral conveying section disposed around a center;

an inlet for said apparatus at said center;

said spiral conveying section including a stationary guide path having a supporting surface that faces outwardly away from said center for supporting the articles on their inwardly facing side;

said spiral conveying section having a conveying system for conveying the articles along said stationary guide path;

said conveying system including a driven endless flexible conveying element that circulates around said spiral conveying section and is adapted to engage the articles to be conveyed on their outwardly facing side;

said conveying system including an endless flexible support member that overlays said guide path and is guided such that it circulates around said spiral conveying section and is adapted to support the articles on its inwardly facing side.

23. An apparatus according to claim 22, wherein said spiral conveying section is constantly curved.

24. An apparatus according to claim 22, wherein said spiral conveying section comprises essentially rectilinear portions and curved portions, said curved portions connect said rectilinear portions to one another.

25. An apparatus according to claim 22, including a second spiral conveying section disposed about said center, and corresponds to the first spiral conveying section;

a conveyor joining said second spiral conveying section and the first spiral conveying section at the center, along which the articles are transferred from one spiral conveying section to the other;

the inlet of one spiral conveying section and the outlet of the other spiral conveying section being offset towards the outside with respect to the center.

26. An apparatus according to claim 25, wherein said second spiral conveying section includes a second conveying system which corresponds to the first conveying system, said second conveying system conveys articles along said second spiral conveying section.

27. An apparatus according to claim 25, wherein the first spiral conveying section includes first windings and said second spiral conveying section includes second windings, said first windings run between said second windings and said second windings run between said first windings.

28. An apparatus according to claim 22, wherein said driven endless flexible conveying element and said endless flexible support member include return strands that are guided back along the guide paths.

29. An apparatus according to claim 22, wherein said support member comprises a steel band that is subjected to tensile and compressive forces.

30. An apparatus according to claim 22, wherein said endless flexible support member includes a return strand, and an advancement device that acts on the return strand of the support member and functions to advance the support member in the direction of circulation thereof.

31. An apparatus according to claim 22, wherein at least a portion of said guide path comprises a series of rollers.

32. An apparatus according to claim 22, wherein at least a portion of said guide path comprises an air duct which is connected to a compressed-air source and is provided with air-outlet openings which open towards the support member which is guided along the air duct.

33. An apparatus according to claim 22, wherein the conveying elements comprise round belts.

34. An apparatus according to claim 22, including a deflection roller and a drive motor and wherein said conveying elements are guided over the deflection roller which is driven by said drive motor.

35. An apparatus according to claim 22, wherein the articles to be conveyed are newspapers, periodicals and parts thereof and supplements therefor, which are arranged in an imbricated formation.

* * * * *